US012077252B2

(12) United States Patent
McBride

(10) Patent No.: US 12,077,252 B2
(45) Date of Patent: Sep. 3, 2024

(54) RETRACTABLE BOAT HAMMOCK

(71) Applicant: Margaritaville Enterprises, LLC, Palm Beach, FL (US)

(72) Inventor: Eric McBride, Manchester Center, VT (US)

(73) Assignee: MARGARITAVILLE ENTERPRISES, LLC, Palm Beach, FL (US)

( * ) Notice: Subject to any disclaimer, the term of this patent is extended or adjusted under 35 U.S.C. 154(b) by 434 days.

(21) Appl. No.: 17/556,705

(22) Filed: Dec. 20, 2021

(65) Prior Publication Data

US 2023/0192245 A1 Jun. 22, 2023

(51) Int. Cl.

| | |
|---|---|
| ***B63B 29/04*** | (2006.01) |
| ***A45F 3/22*** | (2006.01) |
| ***A45F 3/24*** | (2006.01) |

(52) U.S. Cl.

CPC ..... *B63B 29/04* (2013.01); *A45F 3/22* (2013.01); *A45F 3/24* (2013.01)

(58) Field of Classification Search

CPC . B63B 29/00; B63B 29/04; A45F 3/22; A45F 3/24

USPC ..... 114/188; 5/120, 127, 129

See application file for complete search history.

(56) References Cited

U.S. PATENT DOCUMENTS

| | | | | |
|---|---|---|---|---|
| 5,003,652 A * | 4/1991 | Bayless | A45F 3/24 5/127 |
| 6,467,110 B1 * | 10/2002 | Ketcher | A45F 3/24 5/120 |
| 7,874,529 B2 * | 1/2011 | Klemm | A47B 97/00 248/220.1 |
| 9,066,576 B1 * | 6/2015 | Stassinos | B60N 3/008 |
| 10,173,575 B2 * | 1/2019 | Tyler | A45F 3/24 |

* cited by examiner

*Primary Examiner* — Lars A Olson

(74) *Attorney, Agent, or Firm* — Greenberg Traurig, LLP

(57) ABSTRACT

A retractable hammock support system includes a tubular housing and a first plurality of wheels. The first plurality of wheels are secured to the housing. The system includes a tubular member having a first portion disposed within the housing and a second portion disposed outside the housing. The member is slidable into or out from the housing. In a retracted position, the second portion has a first length. In an extended position, the second portion has a second length. The first length is shorter than the second length. The system includes a handle disposed on the member. The handle is disposed on the second portion of the member. The first plurality of wheels are disposed within an interior space of the member. The first plurality of wheels are configured to contact a first internal surface of the member.

20 Claims, 7 Drawing Sheets

RETRACTABLE BOAT HAMMOCK

FIELD

This disclosure relates generally to boats. More specifically, this disclosure relates to a retractable hammock for a boat.

BACKGROUND

Boats are well known for use in fishing, skiing, and other water activities, as well as simple leisurely travel on waterways. One popular type of boat is a pontoon or a tritoon.

SUMMARY

In one embodiment, a retractable hammock support system includes a tubular housing and a first plurality of wheels. In one embodiment, the first plurality of wheels are secured to the housing. In one embodiment, the system includes a tubular member having a first portion disposed within the housing and a second portion disposed outside the housing. In one embodiment, the member is slidable into or out from the housing. In one embodiment, in a retracted position, the second portion has a first length. In one embodiment, in an extended position, the second portion has a second length. In one embodiment, the first length is shorter than the second length. In one embodiment, the system includes a handle disposed on the member. In one embodiment, the handle is disposed on the second portion of the member. In one embodiment, the first plurality of wheels are disposed within an interior space of the member. In one embodiment, the first plurality of wheels are configured to contact a first internal surface of the member.

In one embodiment, a second plurality of wheels is secured to the housing and within the interior space of the member and the housing. In one embodiment, the second plurality of wheels are arranged substantially perpendicular to the first plurality of wheels.

In one embodiment, the first plurality of wheels are configured to contact a first internal surface of the member and the second plurality of wheels are configured to contact a second internal surface of the member. In one embodiment, the first internal surface is substantially perpendicular to the second surface.

In one embodiment, a plurality of wheels are disposed on an end of the member, the plurality of wheels configured to contact a first internal surface of the housing and a second internal surface of the housing disposed opposite the first internal surface.

In one embodiment, a locking pin and a plurality of locking apertures are included. In one embodiment, a first of the locking apertures is configured to maintain the member in the extended position and a second of the locking apertures is configured to maintain the member in the retracted position.

In one embodiment, the system includes a switch. In one embodiment, the switch is in an open state in the extended position and the switch is in a closed state in the retracted position.

In one embodiment, the member includes a hook.

In one embodiment, a system includes a boat and a retractable hammock support system. In one embodiment, the retractable hammock support system includes a tubular housing and a first plurality of wheels. In one embodiment, the first plurality of wheels are secured to the housing. In one embodiment, the system includes a tubular member having a first portion disposed within the housing and a second portion disposed outside the housing. In one embodiment, the member is slidable into or out from the housing. In one embodiment, in a retracted position, the second portion has a first length. In one embodiment, in an extended position, the second portion has a second length. In one embodiment, the first length is shorter than the second length. In one embodiment, the system includes a handle disposed on the member. In one embodiment, the handle is disposed on the second portion of the member. In one embodiment, the first plurality of wheels are disposed within an interior space of the member. In one embodiment, the first plurality of wheels are configured to contact a first internal surface of the member.

In one embodiment, a second plurality of wheels is secured to the housing and within the interior space of the member and the housing. In one embodiment, the second plurality of wheels are arranged substantially perpendicular to the first plurality of wheels.

In one embodiment, the first plurality of wheels are configured to contact a first internal surface of the member and the second plurality of wheels are configured to contact a second internal surface of the member. In one embodiment, the first internal surface is substantially perpendicular to the second internal surface.

In one embodiment, a plurality of wheels are disposed on an end of the member, the plurality of wheels configured to contact a first internal surface of the housing and a second internal surface of the housing disposed opposite the first internal surface.

In one embodiment, a locking pin and a plurality of locking apertures are included. In one embodiment, a first of the locking apertures is configured to maintain the member in the extended position and a second of the locking apertures is configured to maintain the member in the retracted position.

In one embodiment, the system includes a switch. In one embodiment, the switch is in an open state in the extended position and the switch is in a closed state in the retracted position.

In one embodiment, the member includes a hook. In one embodiment, the system includes a hammock and a chain, wherein the hammock is configured to be secured to the hook by the chain when in the extended position.

In one embodiment, the boat includes a bow and a stern. In one embodiment, the hammock support system is secured to the boat at the bow.

In one embodiment, in the retracted position, the hammock support system does not extend beyond the bow of the boat.

In one embodiment, the boat is a pontoon. In one embodiment, the boat is a tritoon

BRIEF DESCRIPTION OF THE DRAWINGS

Reference is made to the drawings that form a part of this disclosure, and which illustrate embodiments in which the devices and methods described herein can be practiced.

Like reference numbers represent the same or similar parts throughout.

DETAILED DESCRIPTION

Figure 1:
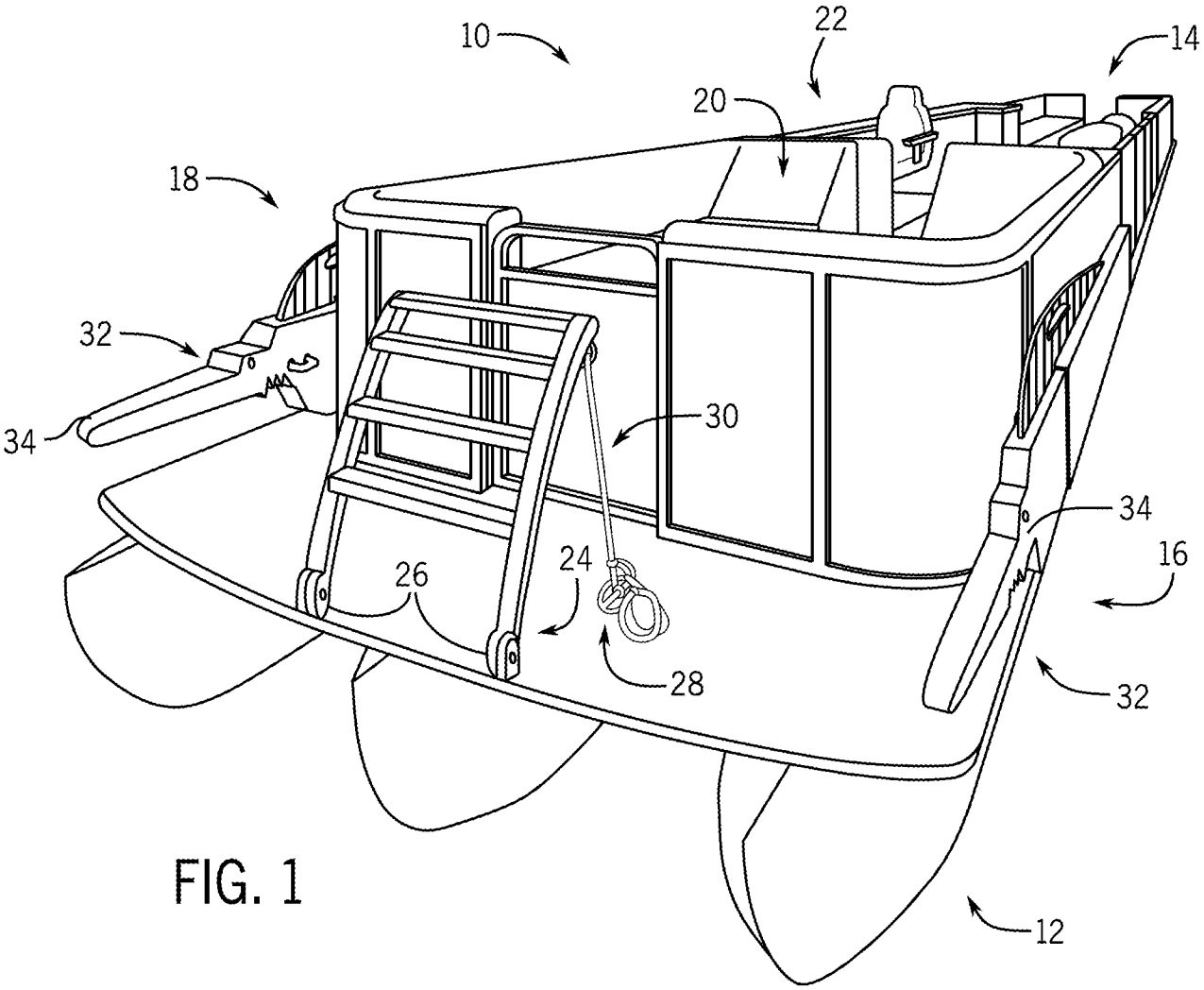
FIG. 1 is a schematic diagram of a perspective view of a boat, according to one embodiment.

FIG. 1 is a schematic diagram of a perspective view of a boat 10, according to one embodiment. The boat 10 in the illustrated embodiment is a type of pontoon boat (e.g., using floats or tubes for floatation). The boat 10 in the illustrated embodiment is a tritoon boat (e.g., having three floats or tubes). It is to be appreciated that the tritoon boat is an example and that other numbers of floats or tubes (e.g., two tubes) are possible. The embodiments described herein may be applied to a boat other than a pontoon boat.

The boat 10 includes a bow 12, a stern 14, a port side 16, and a starboard side 18. There are additional features within the boat 10 that are not critical to the aspects of this disclosure. For example, the boat 10 includes seating 20, a driver's console 22, and one or more engines (not shown) such as one or more outboard engines or the like.

Figure 2:
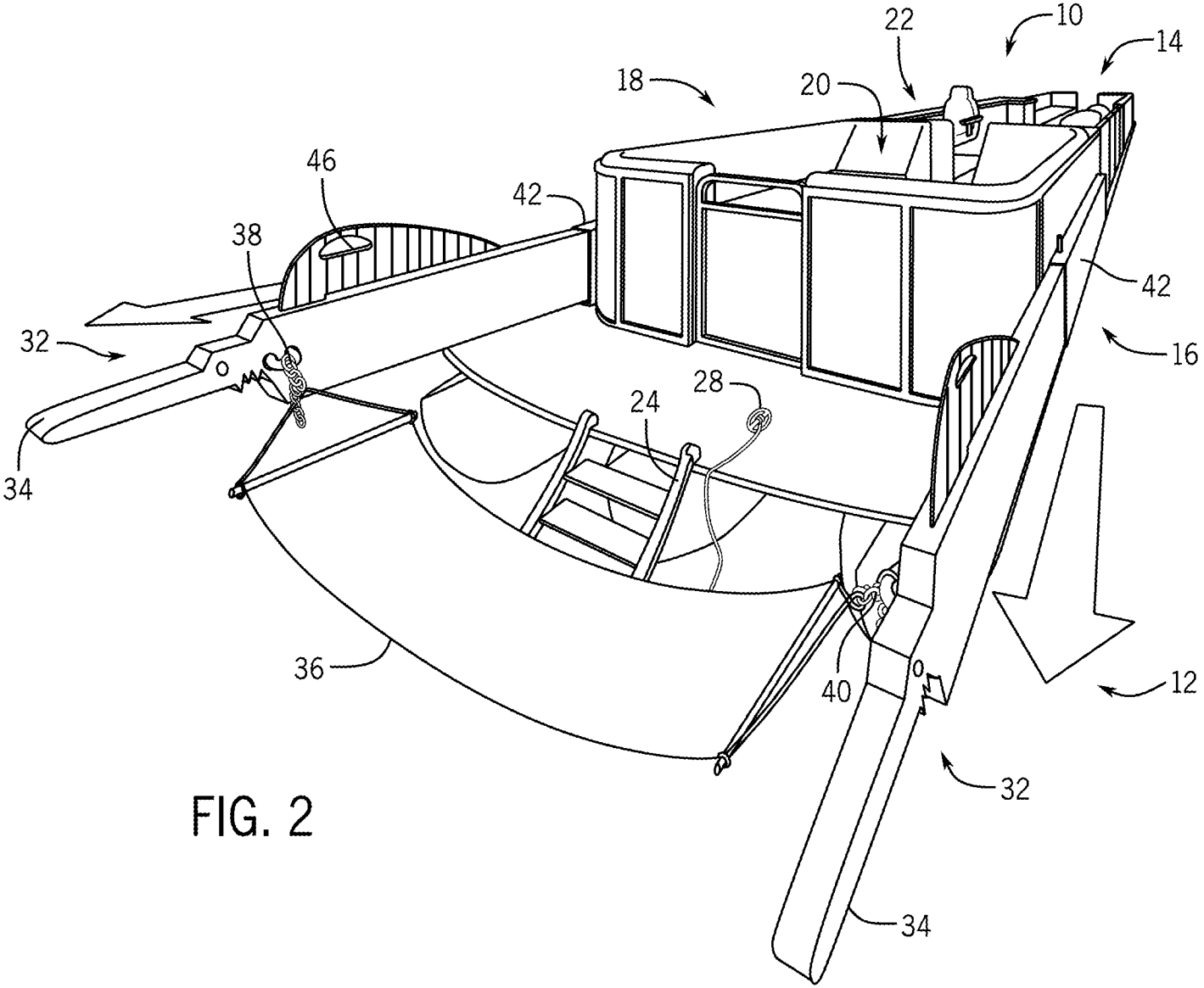
FIG. 2 is a schematic diagram of a perspective view of the boat of FIG. 1, according to one embodiment.

The bow 12 of the boat 10 includes a ladder 24. In one embodiment, the ladder 24 is stowable. For example, in the illustrated embodiment, the ladder 24 can include a plurality of rotatable hinges 26 about which the ladder 24 can be rotated into a storage position (as shown in FIG. 1) or a deployed position (as shown in FIG. 2). In one embodiment, the ladder 24 may not be included on the bow 12 of the boat 10. A cleat 28 can be used to tie the ladder 24 into the storage position, or untied to lower the ladder into the deployed position. In one embodiment, the cleat 28 can be in a form of a ring or can be in a form of a boat cleat. A rope 30 can be secured to the ladder 24 and to the cleat 28. The rope 30 can be used to raise and lower the ladder 24 or to simply maintain the ladder 24 in the storage position.

The boat 10 includes a retractable hammock support system 32 having a plurality of retractable hammock supports 34 from which a hammock can be hung. The retractable hammock support system 32 can be secured to the boat 10 during manufacturing of the boat 10. In one embodiment, the retractable hammock support system 32 can be purchased and secured to the boat 10 after a time of manufacturing, including after a time in which the boat 10 has been used.

FIG. 2 is a schematic diagram of a perspective view of the boat 10 of FIG. 1, according to one embodiment. For the simplicity of this disclosure, features discussed respective of FIG. 1 that are the same in FIG. 2 will not be described again in additional detail.

The retractable hammock support system 32 having the plurality of retractable hammock supports 34 is shown in an extended position. In the extended position, a hammock 36 is hung from the plurality of retractable hammock supports 34.

The retractable hammock support system 32 is illustrated on the bow 12 of the boat 10. It is to be appreciated that the retractable hammock support system 32 could alternatively, or additionally, be installed on a different location of the boat 10, such as the stern 14.

The retractable hammock support system 32 can include one or more safety features that prevent operation of the boat 10 when the retractable hammock support system 32 is in the extended position (as illustrated). For example, the retractable hammock support system 32 can include a switch electrically connected to an ignition of the boat 10 that, when in the extended position, is open and therefore prevents the engine from being started. Additionally, when in the retracted position (FIG. 1), the switch can be closed, enabling the engine to be started.

The retractable hammock support system 32 can be extended (as illustrated) so that the hammock 36 can be hung off the bow 12 of the boat 10. In one embodiment, the hammock 36 can have a chain 38 secured to the hammock 36 and a hook 40 so that the hammock 36 can be arranged to be above a water surface or below the water surface, depending upon a user preference. The chain 38 can be adjustable to modify the hanging height of the hammock 36. The chain 38 can be made of, for example, a material that is corrosion resistant in view of the potential exposure to water. For example, the chain 38 can be made of a stainless steel or the like.

The plurality of retractable hammock supports 34 can include a tubular member that includes at least a portion disposed within a housing 42 that is also tubular such that the tubular member can be moved into or out from the housing 42. The housing 42 is fixed to the boat 10. For example, in the illustrated embodiment, the housing 42 is fixed to an outer wall on the port side 16 and an outer wall on the starboard side 18. The retractable hammock supports 34 will be discussed in additional detail below.

Figure 3:
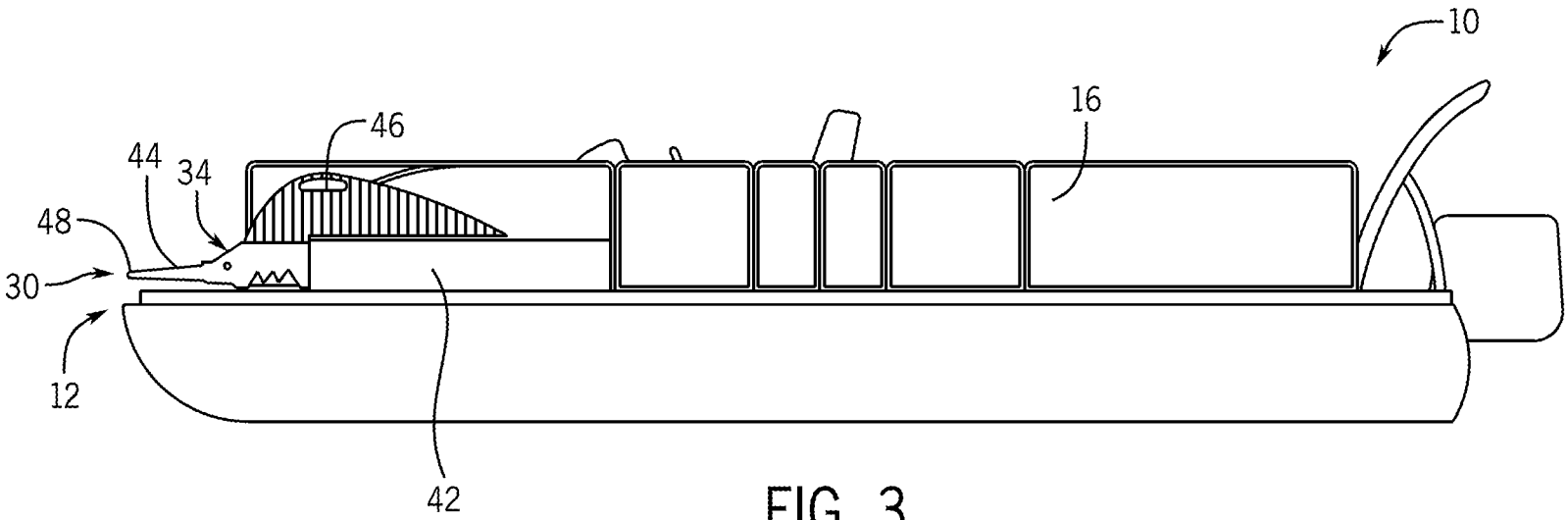
FIG. 3 shows a side view of the boat of FIG. 1, according to one embodiment.

FIG. 3 shows a side view of the boat 10 of FIG. 1, according to one embodiment. The side view of the illustrated embodiment shows the port side 16 of the boat 10. The starboard side 18 of the boat 10 will not be shown and described in additional detail as the starboard side 18 is mirrored relative to the port side 16.

In the illustrated embodiment, like in FIG. 1, the retractable hammock support system 32 is shown in the retracted position. In the retracted position, the retractable hammock supports 34 are disposed within the housing 42. It is to be appreciated that the entire retractable hammock supports 34 are not disposed within the housing 42. For example, a portion 44 may be visible. In one embodiment, the portion 44 can be defined by a location of the hook 40 (not visible in FIG. 3). The portion 44 can also be designed to provide aesthetic features adding to an overall look of the boat 10. For example, in the illustrated embodiment, the portion 44 is designed to resemble a billfish. It is to be appreciated that the billfish is an example and that other aesthetic designs are possible and are within the scope of this disclosure. Additionally, the portion 44 can include a handle 46 for moving the retractable hammock supports 34 between the retracted position (as shown) and the extended position (as shown in FIG. 4).

As shown in FIG. 3, when retracted, the portion 44 of the retractable hammock supports 34 are retracted so an end 48 of the portion 44 does not extend beyond the bow 12 of the boat 10. In some embodiments, the end 48 could extend beyond the bow 12 in the retracted position. However, to increase an overall safety of the boat 10, the end 48 is generally designed to not extend beyond the bow 12 in the retracted position. As used herein, not extending beyond the bow 12 of the boat 10 can include an extension that is substantially the same as the length of the bow 12 or that is less than the length of the bow 12. As used herein, substantially the same includes a length that is the same as the bow 12 subject to, for example, manufacturing tolerances or the like.

Figure 4:
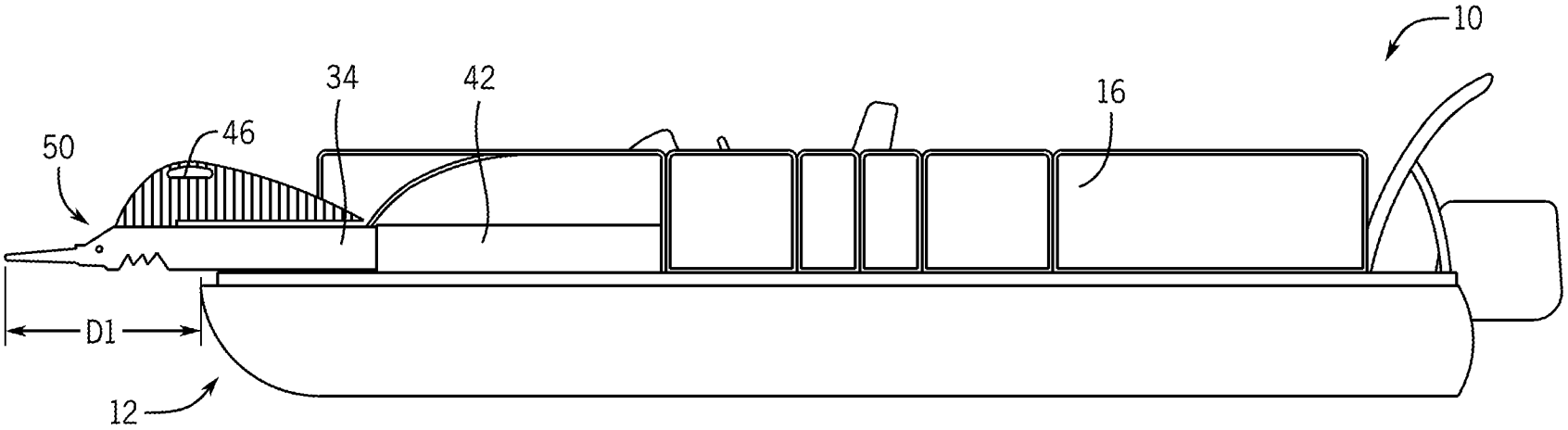
FIG. 4 shows a side view of the boat of FIG. 1, according to one embodiment.

FIG. 4 shows a side view of the boat 10, according to one embodiment. Like FIG. 3, the side view of the illustrated embodiment shows the port side 16 of the boat 10. The starboard side 18 of the boat 10 will not be shown and described in additional detail as the starboard side 18 is mirrored relative to the port side 16.

In the illustrated embodiment, like in FIG. 2, the retractable hammock support system 32 is shown in the extended position. In the extended position, a portion 50 of the retractable hammock supports 34 extends a distance D1 beyond the bow 12 of the boat 10. The distance D1 can be selected to permit hanging of the hammock 36 so that the hammock 36 does not collide with the bow 12 of the boat 10. In one embodiment, the distance D1 is selected so that there is a space between the hammock 36 and the bow 12 in which the ladder 24 is accessible.

The retractable hammock supports 34 extend from the housing 42 when in the extended position. A portion (not visible in FIG. 4) of the retractable hammock supports 34 are within the housing 42 so that the housing 42 supports the weight of an individual in the hammock 36.

Figure 5:
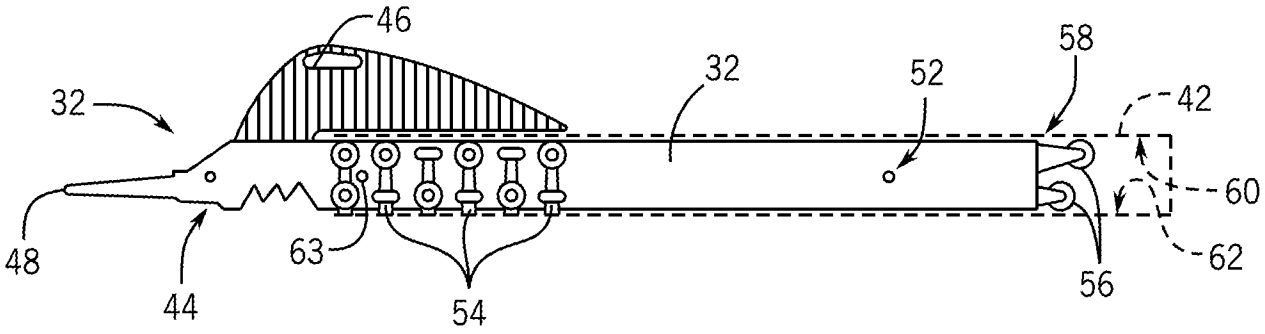
FIG. 5 shows a side view of a retractable hammock support system in a retracted position, according to one embodiment.

FIG. 5 shows a side view of the retractable hammock support system 32 in the retracted position, according to one embodiment. The retractable hammock support system 32 is shown separately from the boat 10 in the illustrated embodiment. Additionally, the housing 42 and the retractable hammock supports 34 are shown so that the interior of the retractable hammock support system 32 is visible.

The retractable hammock support system 32 includes a switch 52. The switch 52 is configured so that, when in the retracted position (as illustrated), a contact on the retractable hammock supports 34 closes the switch 52. In one embodiment, the switch 52 can be a magnetic switch that detects presence of a corresponding magnetic sensor to close the switch 52. In the retracted position, the switch 52 is in the closed state such that a circuit for the ignition of the boat 10 is closed. As a result, the engine can be started when the retractable hammock support system 32 is in the retracted position.

The housing 42 includes a plurality of wheels 54. The plurality of wheels 54 can be arranged so that they provide smoother movement of the retractable hammock supports 34 when extending or retracting from the housing 42. In the illustrated embodiment, the plurality of wheels include wheels 54 arranged to contact an upper internal surface of the retractable hammock supports 34 and wheels arranged to contact side internal surfaces of the retractable hammock supports 34. The side internal surfaces are substantially perpendicular to the upper internal surface. As used herein, substantially perpendicular means within about +/−10° from perpendicular (i.e., 90°). The plurality of wheels 54 can be made of a polyurethane or the like.

The retractable hammock supports 34 also include a plurality of wheels 56 at end 58 of the retractable hammock supports 34 that can contact an upper internal surface 60 and a lower internal surface 62 of the housing 42.

A locking aperture 63 is disposed at a location near the plurality of wheels 54. In the retracted position, a locking pin, for example a spring-loaded locking pin, is disposed within the locking aperture 63. This secures the retractable hammock supports 34 in the retracted position so that, for example, the retractable hammock supports 34 cannot accidentally be extended (e.g., when the boat 10 is in operation).

Figure 6:
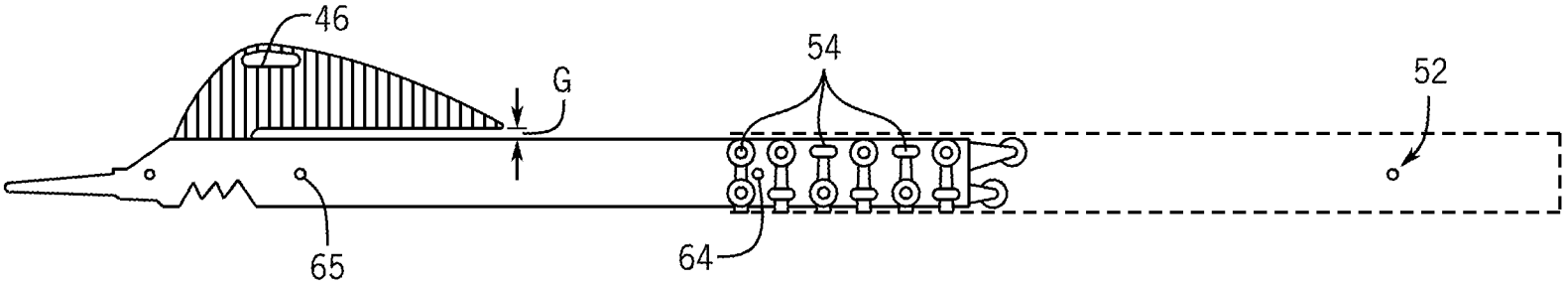
FIG. 6 shows a side view of a retractable hammock support system in an extended position, according to one embodiment.

FIG. 6 shows a side view of the retractable hammock support system 32 in the extended position, according to one embodiment.

When in the extended position, the switch 52 is in the open state. Thus, the switch is in an opened state. As a result, the circuit for the ignition of the boat 10 is open. The engine cannot be started when the retractable hammock support system 32 is in the extended position as a result. This can, for example, increase a safety of the boat 10.

A gap having a distance G is maintained between the handle 46 and the housing 42. This enables the handle 46 to include a portion that extends over the housing 42 when in the retracted position (FIG. 5).

A locking aperture 64 is disposed at a location near the plurality of wheels 54. In the extended position, a locking pin, for example a spring-loaded locking pin, is disposed within the locking aperture 64. This secures the retractable hammock supports 34 in the extended position so that, for example, the retractable hammock supports 34 cannot accidentally be retracted (e.g., when a user is in the hammock 36). Additionally, the retractable hammock supports 34 and the housing 42 can include stopping members that contact each other when in the extended position so that, for example, the retractable hammock supports 34 cannot be over-extended or accidentally removed from the housing 42. In one embodiment, the stopping members can include first and second angled members.

Figure 7:
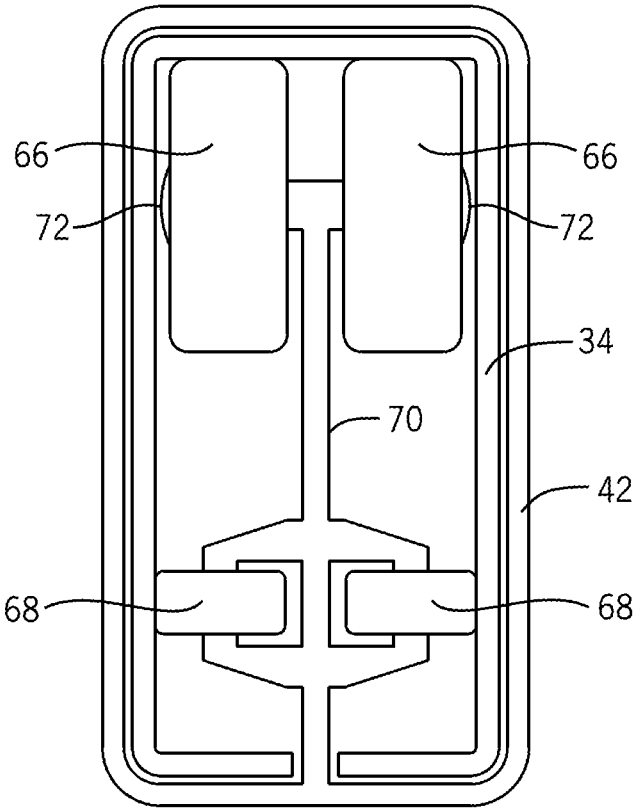
FIG. 7 shows an end view of a retractable hammock support system, according to one embodiment.

FIG. 7 shows an end view of the retractable hammock support system 32, according to one embodiment. The plurality of wheels 54 are visible within the illustrated embodiment.

As illustrated, the plurality of wheels 54 include vertical support wheels 66 and lateral support wheels 68. The vertical support wheels 66 can be of a larger diameter than the lateral support wheels 68 because of the weight of the retractable hammock supports 34. The lateral support wheels 68 can provide stability when sliding the retractable hammock supports 34 from the housing 42. In one embodiment, the lateral support wheels 68 may not be necessary. The plurality of wheels 54 are structurally tied to the housing 42 via support member 70. The plurality of wheels 54 can also include a cap 72 or other guide that covers an axle of the plurality of wheels 54. The cap 72 can be made of a material that is slidable should the retractable hammock supports 34 contact the cap 72.

Figure 8:
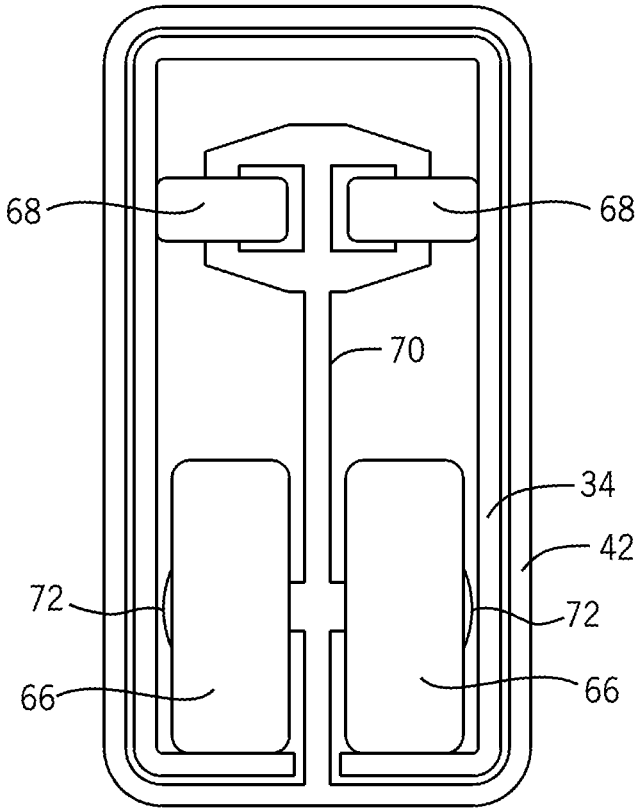
FIG. 8 shows an end view of a retractable hammock support system, according to one embodiment.

FIG. 8 shows an end view of the retractable hammock support system 32, according to one embodiment. The plurality of wheels 54 are visible within the illustrated embodiment. The embodiment of FIG. 8 differs from the embodiment of FIG. 7 in the placement of the vertical support wheels 66. In the embodiment of FIG. 8, the vertical support wheels 66 are arranged to contact a bottom internal surface of the retractable hammock supports 34 instead of a top internal surface.

As illustrated, the plurality of wheels 54 include vertical support wheels 66 and lateral support wheels 68. The vertical support wheels 66 can be of a larger diameter than the lateral support wheels 68 because of the weight of the retractable hammock supports 34. The lateral support wheels 68 can provide stability when sliding the retractable hammock supports 34 from the housing 42. In one embodiment, the lateral support wheels 68 may not be necessary. The plurality of wheels 54 are structurally tied to the housing 42 via support member 70. The plurality of wheels 54 can also include a cap 72 or other guide that covers an axle of the plurality of wheels 54. The cap 72 can be made of a material that is slidable should the retractable hammock supports 34 contact the cap 72.

The terminology used herein is intended to describe embodiments and is not intended to be limiting. The terms "a," "an," and "the" include the plural forms as well, unless clearly indicated otherwise. The terms "comprises" and/or "comprising," when used in this Specification, specify the presence of the stated features, integers, steps, operations, elements, and/or components, but do not preclude the presence or addition of one or more other features, integers, steps, operations, elements, and/or components.

It is to be understood that changes may be made in detail, especially in matters of the construction materials employed and the shape, size, and arrangement of parts without departing from the scope of the present disclosure. This Specification and the embodiments described are examples, with the true scope and spirit of the disclosure being indicated by the claims that follow.

What is claimed is:

1. A retractable hammock support system, comprising:
a tubular housing;
a first plurality of wheels,
wherein the first plurality of wheels are secured to the housing;
a tubular member having a first portion disposed within the housing and a second portion disposed outside the housing,
wherein the member is slidable into or out from the housing,
wherein in a retracted position, the second portion has a first length,
wherein in an extended position, the second portion has a second length,
wherein the first length is shorter than the second length; and
a handle disposed on the member,
wherein the handle is disposed on the second portion of the member,
wherein the first plurality of wheels are disposed within an interior space of the member, and
wherein the first plurality of wheels are configured to contact a first internal surface of the member.

2. The system of claim 1, comprising a second plurality of wheels secured to the housing and within the interior space of the member and the housing, wherein the second plurality of wheels are arranged substantially perpendicular to the first plurality of wheels.

3. The system of claim 2, wherein the second plurality of wheels are configured to contact a second internal surface of the member, the first internal surface being substantially perpendicular to the second internal surface.

4. The system of claim 1, comprising a plurality of wheels disposed on an end of the member, the plurality of wheels configured to contact a first internal surface of the housing and a second internal surface of the housing disposed opposite the first internal surface.

5. The system of claim 1, comprising a locking pin and a plurality of locking apertures, wherein a first of the plurality of locking apertures is configured to maintain the member in the extended position and a second of the plurality of locking apertures is configured to maintain the member in the retracted position.

6. The system of claim 1, comprising a switch.

7. The system of claim 6, wherein the switch is in an open state in the extended position and the switch is in a closed state in the retracted position.

8. The system of claim 1, wherein the member comprises a hook.

9. A system, comprising:
a boat; and
a retractable hammock support system, comprising:
a tubular housing;
a first plurality of wheels,
wherein the first plurality of wheels are secured to the housing;
a tubular member having a first portion disposed within the housing and a second portion disposed outside the housing,
wherein the member is slidable into or out from the housing,
wherein in a retracted position, the second portion has a first length,
wherein in an extended position, the second portion has a second length,
wherein the first length is shorter than the second length; and
a handle disposed on the member,
wherein the handle is disposed on the second portion of the member,
wherein the first plurality of wheels are disposed within an interior space of the member, and
wherein the first plurality of wheels are configured to contact a first internal surface of the member.

10. The system of claim 9, comprising a second plurality of wheels secured to the housing and within the interior space of the member and the housing, wherein the second plurality of wheels are arranged substantially perpendicular to the first plurality of wheels.

11. The system of claim 10, wherein the second plurality of wheels are configured to contact a second internal surface of the member, the first internal surface being substantially perpendicular to the second internal surface.

12. The system of claim 9, comprising a plurality of wheels disposed on an end of the member, the plurality of wheels configured to contact a first internal surface of the housing and a second internal surface of the housing disposed opposite the first internal surface.

13. The system of claim 9, comprising a locking pin and a plurality of locking apertures, wherein a first of the plurality of locking apertures is configured to maintain the member in the extended position and a second of the plurality of locking apertures is configured to maintain the member in the retracted position.

14. The system of claim 9, comprising a switch, wherein the switch is in an open state in the extended position and the switch is in a closed state in the retracted position.

15. The system of claim 9, wherein the member comprises a hook.

16. The system of claim 15, comprising a hammock and a chain, wherein the hammock is configured to be secured to the hook by the chain when in the extended position.

17. The system of claim 9, wherein the boat comprises a bow and a stern, and wherein the retractable hammock support system is secured to the boat at the bow.

18. The system of claim 17, wherein in the retracted position, the retractable hammock support system does not extend beyond the bow of the boat.

19. The system of claim 9, wherein the boat is a pontoon.

20. The system of claim 9, wherein the boat is a tritoon.

* * * * *